US010267547B2

(12) United States Patent
Su et al.

(10) Patent No.: US 10,267,547 B2
(45) Date of Patent: Apr. 23, 2019

(54) FALLING-FILM EVAPORATOR SUITABLE FOR LOW PRESSURE REFRIGERANT

(71) Applicant: Johnson Controls Technology Company, Plymouth, MI (US)

(72) Inventors: Xiuping Su, Wuxi (CN); Li Wang, Wuxi (CN); Jinliang Li, Wuxi (CN); Fang Xue, Wuxi (CN)

(73) Assignees: Johnson Controls Technology Company, Auburn Hills, MI (US); York (Wuxi) Air Conditioning and Refrigeration Co., Ltd., Wuxi, JS (CN); Johnson Controls Building Efficiency Technology (Wuxi) Co., Ltd., Wuxi, JS (CN)

( * ) Notice: Subject to any disclaimer, the term of this patent is extended or adjusted under 35 U.S.C. 154(b) by 70 days.

(21) Appl. No.: 15/436,157

(22) Filed: Feb. 17, 2017

(65) Prior Publication Data

US 2017/0241681 A1 Aug. 24, 2017

(30) Foreign Application Priority Data

Feb. 18, 2016 (CN) ..... 2016 1 0092328
Feb. 18, 2016 (CN) ..... 2016 2 0126915 U

(51) Int. Cl.

| | |
|---|---|
| ***F28D 5/02*** | (2006.01) |
| ***F25B 39/02*** | (2006.01) |
| ***F28D 7/16*** | (2006.01) |
| *F28D 21/00* | (2006.01) |

(52) U.S. Cl.

CPC ..... *F25B 39/02* (2013.01); *F28D 5/02* (2013.01); *F28D 7/16* (2013.01); *F25B 2339/0242* (2013.01); *F25B 2400/23* (2013.01); *F25B 2500/18* (2013.01); *F28D 2021/0071* (2013.01)

(58) Field of Classification Search

CPC ..... F25B 39/02; F25B 2500/18; F28D 7/16; F28D 5/02; F28D 2021/0071

See application file for complete search history.

(56) References Cited

U.S. PATENT DOCUMENTS

| | | | | |
|---|---|---|---|---|
| 6,868,695 | B1 * | 3/2005 | Dingel | F25B 39/028 165/115 |
| 2007/0151279 | A1 * | 7/2007 | Liu | F25B 39/02 62/310 |
| 2012/0118545 | A1 * | 5/2012 | Ayub | F28D 3/02 165/159 |

* cited by examiner

*Primary Examiner* — Ana M Vazquez
(74) *Attorney, Agent, or Firm* — Fletcher Yoder, P.C.

(57) ABSTRACT

A falling-film evaporator includes an evaporator cylinder, a mist eliminator disposed in the evaporator cylinder, a dispenser disposed in the evaporator cylinder, a liquid baffle disposed in the evaporator cylinder, a first chamber formed at least partially by the mist eliminator and the liquid baffle on a first side of the evaporator cylinder below the mist eliminator, a gas returning chamber formed at least partially by the mist eliminator and the liquid baffle on a second side of the evaporator cylinder above the mist eliminator, a gas-liquid separation chamber formed at least partially by the dispenser at an upper portion of the first chamber, and an evaporation chamber formed at least partially by the dispenser at a lower portion of the first chamber, and where the gas returning chamber is in fluid communication with the evaporation chamber.

20 Claims, 4 Drawing Sheets

FALLING-FILM EVAPORATOR SUITABLE FOR LOW PRESSURE REFRIGERANT

CROSS-REFERENCE TO RELATED APPLICATION

This application claims priority to and the benefit of Chinese Patent Application No. 201610092328.X, entitled "FALLING-FILM EVAPORATOR SUITABLE FOR LOW PRESSURE REFRIGERANT," filed Feb. 18, 2016, and Chinese Patent Application No. 201620126915.1, entitled "FALLING-FILM EVAPORATOR SUITABLE FOR LOW PRESSURE REFRIGERANT," filed Feb. 18, 2016, both of which are herein incorporated by reference in their entireties.

BACKGROUND

The present disclosure relates to heating, ventilating, air conditioning, and refrigeration (HVAC&R) systems, and specifically, to a falling-film evaporator with a gas-liquid separation chamber suitable for a low pressure refrigerant.

Falling-film evaporators have been applied to HVAC&R systems to enhance heat transfer efficiency and reduce refrigerant charge. Unfortunately, typical falling-film evaporators may include a refrigerant dispenser that causes refrigerant to incur a relatively high pressure differential due to typical falling-film evaporators used in systems that utilize relatively high pressure refrigerants. Therefore, there is a need for a falling-film evaporator which is suitable for a low pressure refrigerant environment and can uniformly distribute a low pressure refrigerant onto heat exchange tubes more effectively.

SUMMARY

The present disclosure relates to a falling-film evaporator suitable for a low pressure refrigerant, which may overcome inefficiencies of a refrigerant dispenser of a typical falling-film evaporator. For example, embodiments of the present disclosure enhance distribution of a low pressure refrigerant in the falling-film evaporator, such that a falling-film evaporator may be used in systems that utilize low pressure refrigerants.

In some embodiments, a falling-film evaporator that includes an evaporator cylinder, a mist eliminator disposed in the evaporator cylinder, a dispenser disposed in the evaporator cylinder, a liquid baffle disposed in the evaporator cylinder, a first chamber formed at least partially by the mist eliminator and the liquid baffle on a first side of the evaporator cylinder below the mist eliminator, a gas returning chamber formed at least partially by the mist eliminator and the liquid baffle on a second side of the evaporator cylinder above the mist eliminator, a gas-liquid separation chamber of the first chamber formed at least partially by the dispenser at an upper portion of the first chamber, and an evaporation chamber of the first chamber formed at least partially by the dispenser at a lower portion of the first chamber, and where the gas returning chamber is in fluid communication with at least a portion of the evaporation chamber.

In some embodiments, the falling-film evaporator further includes an evaporator inlet pipe, the evaporator inlet pipe being in communication with the gas-liquid separation chamber.

In some embodiments, a falling-film tube bundle is disposed in the evaporation chamber.

In some embodiments, the falling-film evaporator further includes an evaporator outlet pipe, the evaporator outlet pipe being in communication with the gas returning chamber.

In some embodiments, the evaporator outlet pipe is in communication with a compressor suction port.

In some embodiments, the dispenser is arc-shaped along an axial direction of the evaporator cylinder, such that the dispenser has a height that is greatest at a middle portion of the evaporator cylinder and least at end portions of the evaporator cylinder.

In some embodiments, the mist eliminator is a strainer or a Z-shaped plate.

In some embodiments, a liquid separation tank is disposed below the evaporator inlet pipe, the liquid separation tank extending to ends of the evaporator cylinder along an axial direction of the evaporator cylinder.

In some embodiments, the dispenser may include a porous material, such as, for example, a porous plate or a steel wire mesh.

In some embodiments, a method of using the falling-film evaporator may include receiving a two-phase refrigerant in a gas-liquid separation chamber of an evaporation cylinder of the falling-film evaporator via an evaporator inlet pipe, separating the two-phase refrigerant into refrigerant vapor and refrigerant liquid in the gas-liquid separation chamber, directing the refrigerant vapor through a mist eliminator and into a gas returning chamber of the evaporation cylinder, accumulating the refrigerant liquid in the gas-liquid separation chamber, where the refrigerant liquid is configured to uniformly drip through a dispenser onto a tube bundle disposed in an evaporation chamber of the falling-film evaporator, evaporating the refrigerant liquid to the refrigerant vapor in the evaporation chamber, combining the refrigerant vapor from the evaporation chamber with the refrigerant vapor from the gas returning chamber, and directing the refrigerant vapor to an evaporator outlet pipe.

In some embodiments, after the refrigerant liquid enters the liquid separation tank, the refrigerant liquid may reach a target amount, such that the refrigerant liquid overflows from the liquid separation tank.

In some embodiments, after the refrigerant enters the gas-liquid separation chamber via the evaporator inlet pipe, the liquid may flow towards the ends of the evaporator cylinder along the axial direction of the evaporator cylinder.

The present disclosure includes any combination of any one or more of the above implementation solutions.

The present disclosure provides a falling-film evaporator with a gas-liquid separation chamber suitable for a low pressure refrigerant, which has advantages of a simple structure, high heat transfer efficiency, less refrigerant charge, and so on.

DRAWINGS

Figure 6:
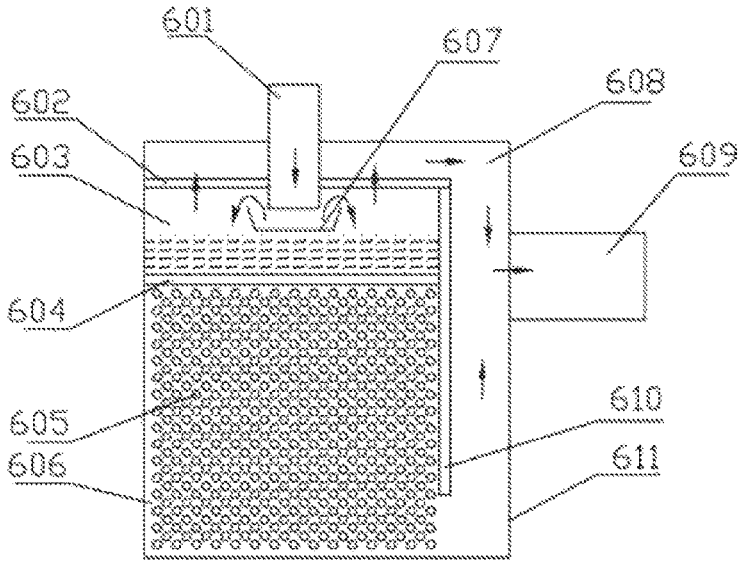
Figure 7:
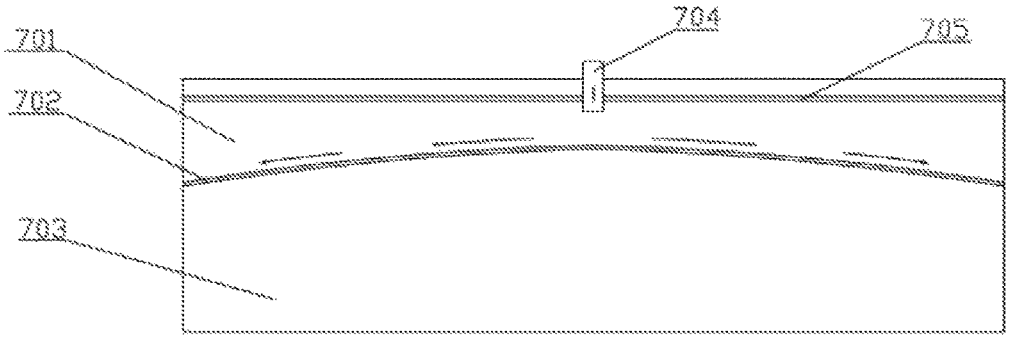

FIG. 6 is a schematic of an embodiment of a falling-film evaporator having a gas-liquid separation chamber and a liquid separation tank disposed below an evaporator inlet pipe, in accordance with an embodiment of the present disclosure; and FIG. 7 is a schematic of an embodiment of a falling-film evaporator having a gas-liquid separation chamber and an arc-shaped refrigerant dispenser, in accordance with an aspect of the present disclosure.

DETAILED DESCRIPTION

Figure 1:
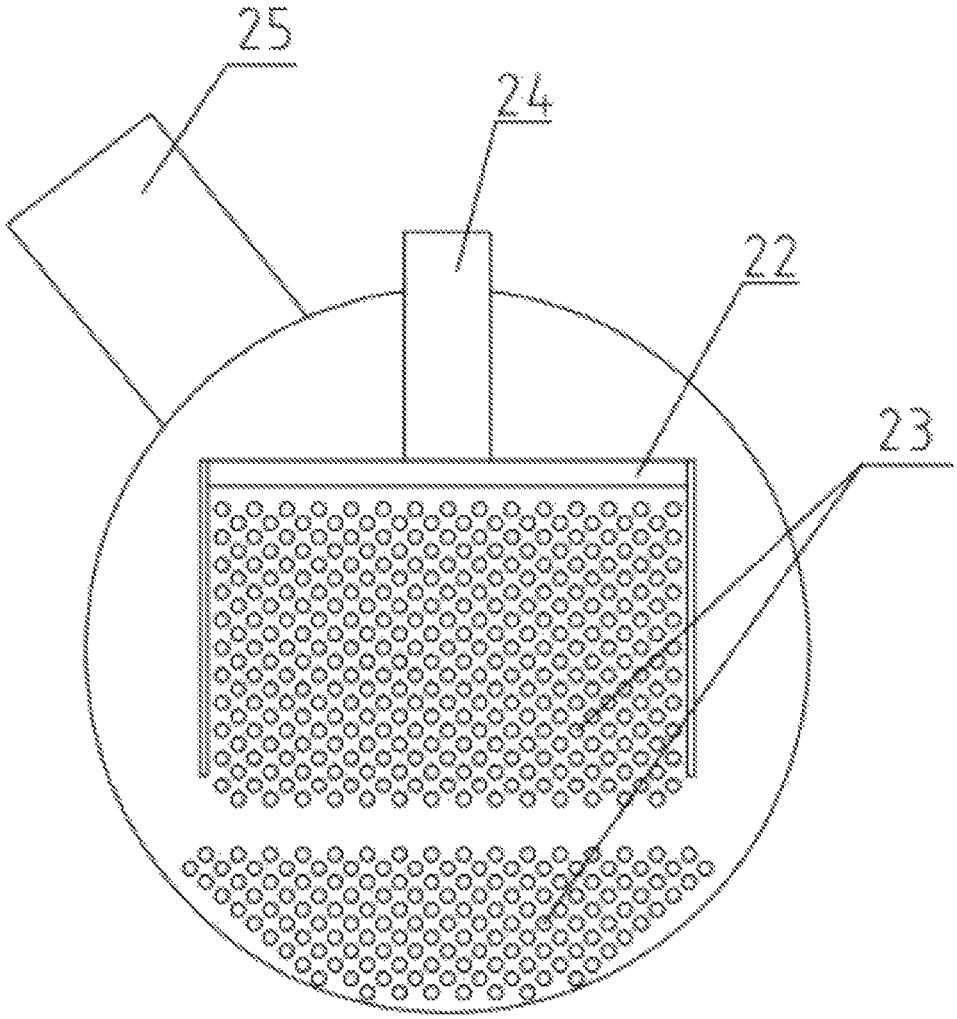
FIG. 1 PRIOR ART
FIG. 1 is a schematic illustration of a conventional falling-film evaporator.

A typical falling-film evaporator configured to utilize a relatively high pressure refrigerant (e.g., R134a) may generally include a structure as shown in FIG. 1. For example, as shown in the illustrated embodiment of FIG. 1, the falling-film evaporator may include an evaporator outlet pipe 25, a liquid inlet pipe 24, a refrigerant dispenser 22, and/or evaporation tube bundles 23. In some embodiments, a gas-liquid refrigerant (e.g., two-phase refrigerant) may pass through the liquid inlet pipe 24 and enter the evaporator after passing through the refrigerant dispenser 22. Once the refrigerant enters the evaporator, refrigerant droplets (e.g., liquid refrigerant) may fall onto the evaporation tube bundles 23, such that the refrigerant droplets absorb heat from fluid in the evaporation tube bundles 23 and evaporate into refrigerant vapor. The generated refrigerant vapor is then discharged via the evaporator outlet pipe 25, where it may enter a compressor.

The refrigerant dispenser 22 may enhance uniform distribution of the refrigerant onto the evaporation tube bundles 23. However, typical falling-film evaporators may be configured to utilize a relatively high pressure refrigerant (e.g., R134a). Therefore, the refrigerant dispenser 22 may include a pressure difference that accommodates the high pressure refrigerant to ultimately direct the refrigerant over the evaporation tube bundles 23. For example, in some cases, the pressure difference across the refrigerant dispenser may be up to 150 kilopascals (kPa) or up to 300 kPa.

In accordance with embodiments of the present disclosure, the refrigeration system may include a low pressure refrigerant, such as R1233zd(E). Low pressure refrigerants are becoming more desirable because they are generally more environmentally friendly and efficient than high pressure refrigerants. Table 1 shows a comparison between respective evaporation pressures and condensation pressures of R1233zd(E) and R134a under typical refrigeration working conditions (with an evaporation temperature of 5° C. and a condensation temperature of 36.7° C.). As shown, a difference between the evaporation pressure (Pevap, kPA) and the condensation pressure (Pcond, kPa) of R1233zd(E) is 23.1% of the pressure difference of R134a. Accordingly, the refrigerant dispenser 22 may be configured to accommodate the large pressure difference of relatively high pressure refrigerants to distribute the high pressure refrigerants over the evaporation tube bundles 23. However, such a pressure difference may be too high for low pressure refrigerants, such that the refrigerant dispenser 22 may not sufficiently distribute low pressure refrigerant over the evaporation tube bundles 23 (e.g., the low pressure refrigerant may simply fall through the refrigerant dispenser 22 without dispersing towards ends of the refrigerant dispenser 22).

TABLE 1

Typical refrigeration operating conditions

| | R1233zd(E) | R134a | R1233zd(E) vs R134a |
|---|---|---|---|
| Tevap | 5 | 5 | |
| Tcond | 36.7 | 36.7 | |
| Pevap, kPa | 59.44 | 349.66 | 17.0% |
| Pcond, kPa | 193.65 | 929.57 | 20.8% |
| Compression Ratio | 3.26 | 2.66 | 122.6% |
| Pressure Difference, kPa | 134.21 | 579.91 | 23.1% |

Embodiment 1

Figure 2:
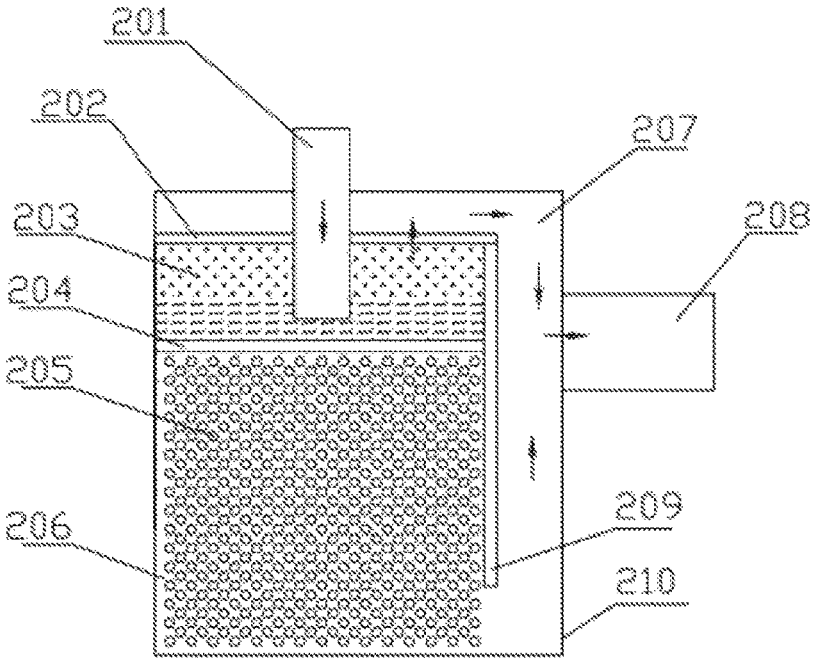
FIG. 2 is a schematic of an embodiment of a falling-film evaporator having a gas-liquid separation chamber, in accordance with an embodiment of the present disclosure.

A schematic diagram of a structure suitable for a falling-film evaporator according to embodiments of the present disclosure is shown in FIG. 2. The falling-film evaporator may include an evaporator cylinder 210, a mist eliminator 202, a dispenser 204, and a liquid baffle 209. As shown in the illustrated embodiment of FIG. 2, the mist eliminator 202 and the liquid baffle 209 may partition the evaporator cylinder 210 into a first chamber located on a first side of the evaporator cylinder 210 below the mist eliminator 202 and a gas returning chamber 207 formed by the remaining parts (e.g., on a second side of the evaporator cylinder 210 and above the mist eliminator 202). Further, the dispenser 204 may partition the first chamber into a gas-liquid separation chamber 203 located at an upper portion of the dispenser 204 (e.g., above the dispenser 204 with respect to the evaporator cylinder 210) and an evaporation chamber 206 located at a lower portion of the dispenser 204 (e.g., below the dispenser 204 with respect to the evaporator cylinder 210). As shown in the illustrated embodiment, the gas returning chamber 207 is in fluid communication with at least a portion of the evaporation chamber 206.

A two-phase refrigerant may enter the gas-liquid separation chamber 203 via an evaporator inlet pipe 201. Upon reaching the gas-liquid separation chamber 203, the gas-liquid refrigerant may be separated into refrigerant liquid and refrigerant vapor due to gravitational forces pulling refrigerant liquid toward the dispenser 204. The refrigerant vapor may enter the gas returning chamber 207 after passing through the mist eliminator 202 disposed at a top portion of the gas-liquid separation chamber 203. The refrigerant liquid may be deposited on the dispenser 204 at a bottom portion of the gas-liquid separation chamber 203 and form a liquid level, which may ultimately reach a target height. When the refrigerant liquid accumulates such that the liquid level reaches the target height, the refrigerant liquid may uniformly drip through the dispenser 204 onto the falling-film tube bundle 205 where the refrigerant liquid may absorb heat from a fluid flowing through the falling-film tube bundle 205. In some embodiments, the refrigerant liquid may absorb a sufficient amount of heat in the evaporation chamber 206 to evaporate into refrigerant vapor. The refrigerant vapor generated in the evaporation chamber 206 may then enter the gas returning chamber 207 via an opening at the bottom of the liquid baffle 209. The refrigerant vapor flowing through the opening at the bottom of the liquid baffle 209 may combine with the refrigerant vapor in the gas returning chamber 207 and enter a compressor suction port via an evaporator outlet pipe 208.

As shown in the illustrated embodiment of FIG. 2, the cross-section of the evaporator cylinder 210 may be rectangular. In other embodiments, the cross-section of the evaporator cylinder 210 may be circular or another suitable shape.

In some embodiments, the liquid baffle 209 may extend along an entire length of the evaporator cylinder 210 along an axial direction of the evaporator cylinder 210. Additionally, the liquid baffle 209 may be disposed substantially vertically with respect to a base of the evaporator cylinder 210. However, in other embodiments, the liquid baffle 209 may be disposed non-vertically, such that the liquid baffle 209 is disposed at an angle with respect to the base of the evaporator cylinder 210 that is not 90 degrees. Further, in some embodiments, the cross-section of the liquid baffle 209 may be rectangular, arc-shaped, or another suitable shape.

Figure 3:
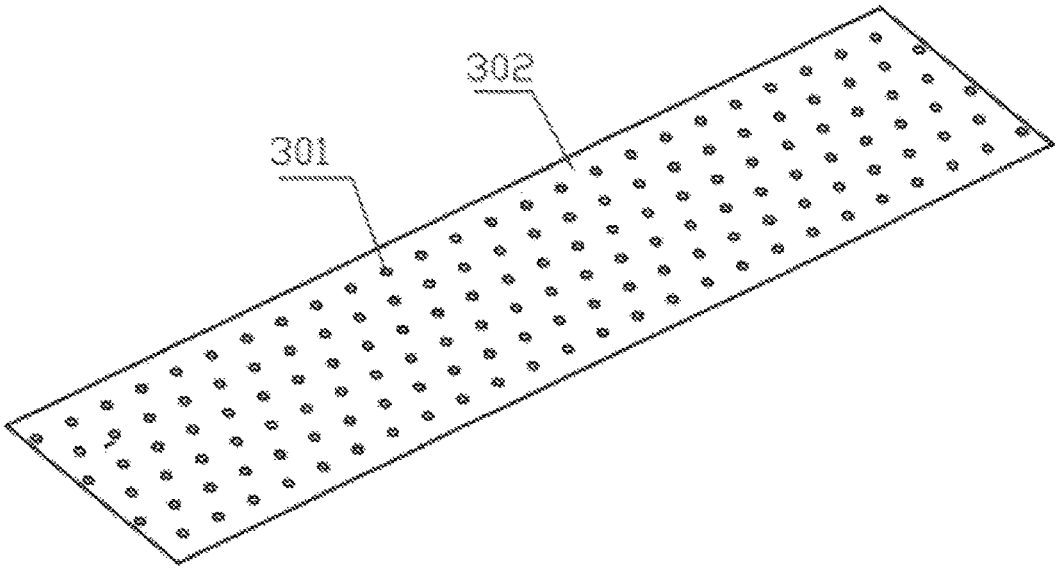
FIG. 3 is schematic of an embodiment of a porous plate that may be used as a refrigerant dispenser in the falling-film evaporator of FIG. 2, in accordance with an embodiment of the present disclosure.
Figure 4:
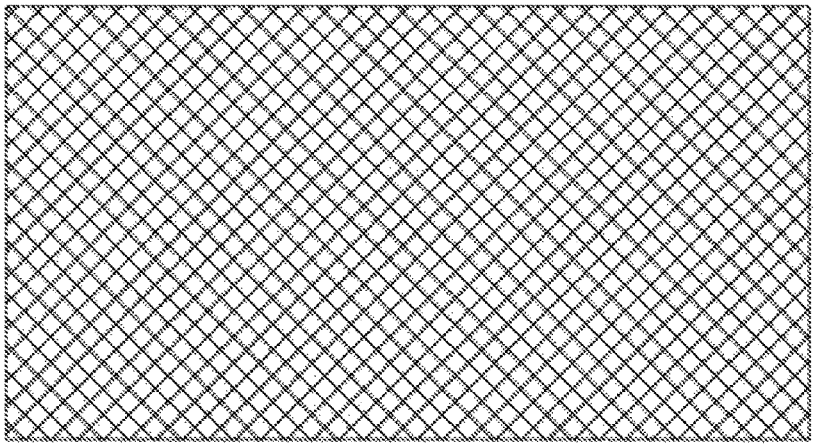
FIG. 4 is a schematic of an embodiment of a steel wire mesh that may be used as a refrigerant dispenser in the falling-film evaporator of FIG. 2, in accordance with an embodiment of the present disclosure.

In some embodiments, the dispenser 204 may include a porous plate 302 (e.g., a plate that includes one or more holes 301), as shown in FIG. 3. In other embodiments, the dispenser 204 may include steel wire mesh, as shown in FIG. 4. In still further embodiments, the dispenser 204 may include another suitable porous material. As discussed above, the refrigerant liquid is deposited on the dispenser 204 after entering the gas-liquid separation chamber 203. When a target refrigerant liquid level is reached on the dispenser 204, an amount of liquid refrigerant entering the gas-liquid separation chamber 203 and an amount of refrigerant liquid that flows into the evaporation chamber 206 through the dispenser 204 may be substantially equal and/or balanced.

Assuming that a pressure drop generated after the refrigerant liquid flows through the dispenser 204 is ΔP, the target refrigerant liquid level, h, in the gas-liquid separation chamber 203 may be expressed as:

$$h = \frac{\Delta P}{\rho g},$$

where ρ is the density of the refrigerant liquid in the gas-liquid separation chamber 203, and g is the gravitational acceleration constant.

The dispenser 204 may be configured such that the pressure drop, ΔP, between the refrigerant liquid entering the dispenser 204 and the refrigerant liquid 204 exiting the dispenser 204 is within a target range. Maintaining the pressure drop, ΔP, within the target range may also maintain a particular refrigerant liquid level, h, above the dispenser 204. Further, maintaining the pressure drop, ΔP, within the target range may enable the falling-film evaporator to utilize a low pressure refrigerant while maintaining an efficiency and capacity of the overall system.

Figure 5:
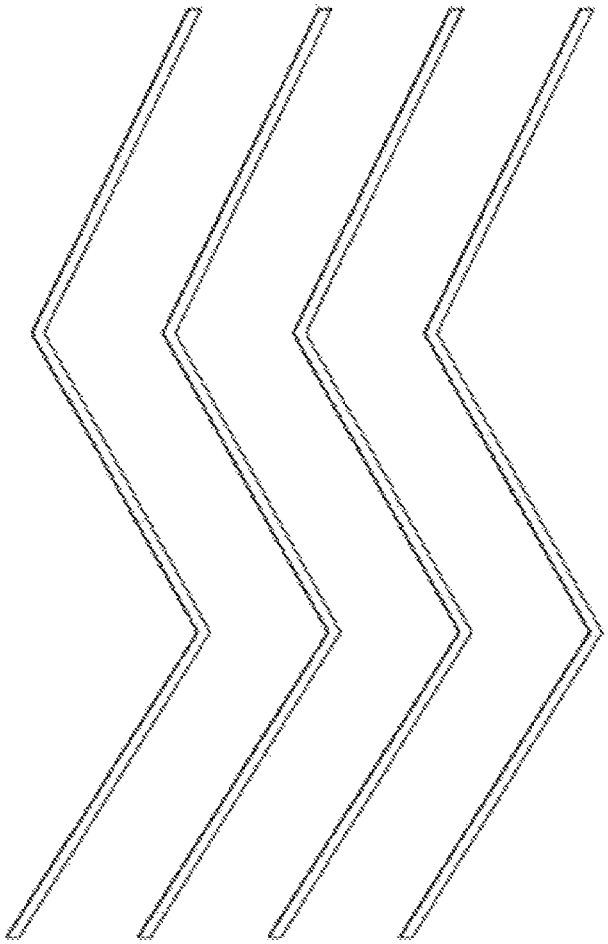
FIG. 5 is a schematic of an embodiment of a Z-shaped plate that may be used as a mist eliminator in the falling-film evaporator of FIG. 2, in accordance with an embodiment of the present disclosure.

In some embodiments, the mist eliminator 202 may employ a Z-shaped plate as shown in FIG. 5. Further, the mist eliminator 202 may include a porous material, such as the steel wire mesh of the dispenser 204. When the refrigerant vapor flows through the mist eliminator 202, refrigerant liquid entrained within the refrigerant vapor may be captured by the mist eliminator 202. The refrigerant liquid captured by the mist eliminator 202 may then fall back into the gas-liquid separation chamber 203 after a certain quantity of the refrigerant liquid is captured in the mist eliminator 202.

Embodiment 2

FIG. 6 is another embodiment of the falling-film evaporator that may be configured to utilize a low pressure refrigerant. Compared with the embodiment of the falling-film evaporator of FIG. 2, a liquid separation tank 607 may disposed below an evaporator inlet pipe 601 within an evaporator cylinder 611. In some embodiments, the liquid separation tank 607 may extend along an entire length of the evaporator cylinder 611 along an axial direction of the evaporator cylinder 611. After the refrigerant enters the liquid separation tank 607, the refrigerant liquid may be deposited in the liquid separation tank 607. When a sufficient amount of the refrigerant liquid collects in the liquid separation tank 607, the refrigerant liquid may overflow from the liquid separation tank 607 and into a gas-liquid separation chamber 603. Including the liquid separation tank 607 may further enhance a uniformity of distribution of the refrigerant liquid along the axial direction of the evaporator cylinder 611. As shown in the illustrated embodiment of FIG. 6, the evaporator cylinder 611 may further include a mist eliminator 602, the gas-liquid separation chamber 603, a dispenser 604, a falling-film tube bundle 605, an evaporation chamber 606, a gas returning chamber 608, an evaporator outlet pipe 609, and/or a liquid baffle 610.

Embodiment 3

FIG. 7 is another embodiment of the falling-film evaporator that may be configured to utilize a low pressure refrigerant. Compared with the embodiment of FIG. 2, a dispenser 702 is arc-shaped along an axial direction of an evaporator cylinder, such that the dispenser 702 includes a height that is greatest at a middle portion of the evaporator cylinder and lowest at end portions of the evaporator cylinder. After a refrigerant enters a gas-liquid separation chamber 701 via an evaporator inlet pipe 704, the refrigerant liquid may flow towards the end portions of the evaporator cylinder along the axial direction of the evaporator cylinder. Directing the liquid refrigerant to the end portions of the evaporator cylinder may enhance a uniformity of distribution of the refrigerant along the axial direction. Additionally, the falling-film evaporator of FIG. 7 may include a mist eliminator 705 and/or an evaporation chamber 703.

While only certain features and embodiments have been illustrated and described, many modifications and changes may occur to those skilled in the art (e.g., variations in sizes, dimensions, structures, shapes and proportions of the various elements, values of parameters (e.g., temperatures, pressures, etc.), mounting arrangements, use of materials, colors, orientations, etc.) without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described (i.e., those unrelated to the presently contemplated best mode of carrying out the embodiments of the present disclosure, or those unrelated to enabling the claimed disclosure). It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A falling-film evaporator for a low pressure refrigerant, comprising:

an evaporator cylinder;

a mist eliminator disposed in the evaporator cylinder;

a dispenser disposed in the evaporator cylinder;

a liquid baffle disposed in the evaporator cylinder;

a first chamber formed at least partially by the mist eliminator and the liquid baffle, wherein the first chamber is on a first side of the evaporator cylinder below the mist eliminator;

a gas returning chamber formed at least partially by the mist eliminator and the liquid baffle, wherein the gas returning chamber is on a second side of the evaporator cylinder above the mist eliminator;

a gas-liquid separation chamber of the first chamber formed at least partially by the dispenser and the mist eliminator, wherein the gas-liquid separation chamber is at an upper portion of the first chamber, wherein the gas-liquid separation chamber is configured to separate a two-phase refrigerant into refrigerant vapor and refrigerant liquid, and wherein the gas-liquid separation chamber is configured to direct a flow of the refrigerant vapor from the gas-liquid separation chamber, through the mist eliminator, and into the gas returning chamber; and an evaporation chamber of the first chamber formed at least partially by the dispenser, wherein the evaporation chamber is at a lower portion of the first chamber, and wherein the gas returning chamber is in fluid communication with at least a portion of the evaporation chamber.

2. The falling-film evaporator of claim 1, comprising an evaporator inlet pipe, wherein the evaporator inlet pipe is in fluid communication with the gas-liquid separation chamber.

3. The falling-film evaporator of claim 1, comprising a falling-film tube bundle disposed in the evaporation chamber.

4. The falling-film evaporator of claim 3, wherein the falling-film tube bundle is configured to transfer heat to the liquid refrigerant in the evaporation chamber.

5. The falling-film evaporator of claim 1, comprising an evaporator outlet pipe in fluid communication with the gas returning chamber.

6. The falling-film evaporator of claim 1, wherein the dispenser is arc-shaped along an axial direction of the evaporator cylinder, such that a height of the dispenser is greatest at a middle portion of the evaporator cylinder and lowest at end portions of the evaporator cylinder.

7. The falling-film evaporator of claim 1, wherein the mist eliminator is a strainer or a Z-shaped plate.

8. The falling-film evaporator of claim 1, comprising a liquid separation tank disposed below an evaporator inlet pipe, wherein the liquid separation tank extends to ends of the evaporator cylinder along an axial direction of the evaporator cylinder.

9. The falling-film evaporator of claim 1, wherein the dispenser comprises a porous material or a porous plate.

10. The falling-film evaporator of claim 1, wherein the dispenser comprises steel wire mesh.

11. A method of using a falling-film evaporator, comprising:

receiving a two-phase refrigerant in a gas-liquid separation chamber of an evaporation cylinder of the falling-film evaporator via an evaporator inlet pipe;

separating the two-phase refrigerant into refrigerant vapor and refrigerant liquid in the gas-liquid separation chamber;

directing the refrigerant vapor through a mist eliminator and into a gas returning chamber of the evaporation cylinder;

accumulating the refrigerant liquid in the gas-liquid separation chamber, wherein the refrigerant liquid is configured to uniformly drip through a dispenser onto a tube bundle disposed in an evaporation chamber of the falling-film evaporator;

evaporating the refrigerant liquid to refrigerant vapor in the evaporation chamber;

combining the refrigerant vapor from the evaporation chamber with the refrigerant vapor from the gas returning chamber; and directing the refrigerant vapor to an evaporator outlet pipe.

12. The method of claim 11, comprising:

receiving the two-phase refrigerant in a liquid separation tank of the gas-liquid separation chamber;

accumulating liquid refrigerant in the liquid separation tank; and receiving the liquid refrigerant in the gas-liquid separation chamber when a level of the liquid refrigerant reaches a target height in the liquid separation tank.

13. The method of claim 11, wherein passing the refrigerant vapor through the mist eliminator comprises collecting refrigerant liquid entrained in the refrigerant vapor.

14. The method of claim 11, wherein evaporating the refrigerant liquid to the refrigerant vapor in the evaporation chamber comprises transferring heat from fluid in the tube bundle to the refrigerant liquid in the evaporation chamber.

15. The method of claim 11, comprising directing the refrigerant vapor from the evaporator outlet pipe to a compressor.

16. A falling-film evaporator, comprising:

an evaporator cylinder;

a mist eliminator disposed in the evaporator cylinder;

a dispenser disposed in the evaporator cylinder;

a liquid baffle disposed in the evaporator cylinder;

a first chamber formed at least partially by the mist eliminator and the liquid baffle, wherein the first chamber is on a first side of the evaporator cylinder below the mist eliminator;

a gas returning chamber formed at least partially by the mist eliminator and the liquid baffle, wherein the gas returning chamber is on a second side of the evaporator cylinder above the mist eliminator;

a gas-liquid separation chamber of the first chamber formed at least partially by the dispenser and the mist eliminator, wherein the gas-liquid separation chamber is at an upper portion of the first chamber, wherein the gas-liquid separation chamber is configured to separate a two-phase refrigerant into refrigerant vapor and refrigerant liquid, and wherein the gas-liquid separation chamber is configured to direct a flow of the refrigerant vapor from the gas-liquid separation chamber, through the mist eliminator, and into the gas returning chamber;

an evaporation chamber of the first chamber formed at least partially by the dispenser, wherein the evaporation chamber is at a lower portion of the first chamber, and wherein the gas returning chamber is in fluid communication with at least a portion of the evaporation chamber; and a liquid separation tank disposed between the mist eliminator and the dispenser, wherein refrigerant entering the falling-film evaporator is directed into the liquid separation tank from an evaporator inlet pipe.

17. The falling-film evaporator of claim 16, wherein the liquid separation tank extends to ends of the evaporator cylinder along an axial direction of the evaporator cylinder.

18. The falling-film evaporator of claim 16, wherein the dispenser comprises a porous material or a porous plate.

19. The falling-film evaporator of claim 16, wherein the dispenser comprises steel wire mesh.

20. The falling-film evaporator of claim 16, wherein the dispenser is arc-shaped along an axial direction of the evaporator cylinder, such that a height of the dispenser is greatest at a middle portion of the evaporator cylinder and lowest at end portions of the evaporator cylinder.

* * * * *